US008468750B2

(12) United States Patent
Clearfield et al.

(10) Patent No.: US 8,468,750 B2
(45) Date of Patent: Jun. 25, 2013

(54) METHOD FOR SEALING FLASHING JOINTS BELOW FLASHING

(75) Inventors: Howard M. Clearfield, San Jose, CA (US); Gary D. Parsons, Midland, MI (US); Katherine L. Johnson, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 114 days.

(21) Appl. No.: 13/110,027

(22) Filed: May 18, 2011

(65) Prior Publication Data

US 2011/0296768 A1 Dec. 8, 2011

Related U.S. Application Data

(60) Provisional application No. 61/351,982, filed on Jun. 7, 2010.

(51) Int. Cl.
*E04D 1/36* (2006.01)
*E04D 13/14* (2006.01)
*E04D 3/38* (2006.01)

(52) U.S. Cl.
USPC ..... 52/58; 52/60; 52/61; 52/62

(58) Field of Classification Search
USPC ..... 52/58, 60, 61, 62
See application file for complete search history.

(56) References Cited

U.S. PATENT DOCUMENTS 5,091,235 A 2/1992 Vergnano
5,630,297 A * 5/1997 Rutherford ..... 52/58
5,979,123 A * 11/1999 Brockman ..... 52/101
7,222,462 B2 * 5/2007 Ellingson ..... 52/62
7,543,413 B2 * 6/2009 Sourlis ..... 52/169.5
7,543,414 B2 * 6/2009 Sourlis ..... 52/169.5
7,546,719 B1 * 6/2009 Guevara ..... 52/716.2
7,757,450 B2 * 7/2010 Reyes et al. ..... 52/396.05
8,001,736 B2 * 8/2011 Goldberg et al. ..... 52/209
8,074,409 B2 * 12/2011 Goldberg et al. ..... 52/209
2002/0152693 A1 * 10/2002 Krogstad ..... 52/58
2006/0254169 A1 * 11/2006 McFadden ..... 52/344
2007/0130861 A1 * 6/2007 Chenier et al. ..... 52/371
2007/0180791 A1 * 8/2007 Amster et al. ..... 52/741.3
2008/0005986 A1 * 1/2008 Thompson ..... 52/290
2008/0016808 A1 1/2008 Pilz
2009/0038249 A1 2/2009 Coulton et al.
2009/0208687 A1 8/2009 Schroer et al.
2010/0139178 A1 * 6/2010 Ehrman et al. ..... 52/58
2010/0281612 A1 * 11/2010 Cook ..... 4/614

* cited by examiner

*Primary Examiner* — Mark Wendell
(74) *Attorney, Agent, or Firm* — Steven W. Mork

(57) ABSTRACT

Seal a flashing joint on an open frame structure using a first barrier sheet having first and second adhesive strips on opposing primary surfaces proximate to opposing edges and running the length of the first barrier sheet by applying the first barrier sheet over the flashing joint with one edge below the flashing joint and adhering an adhesive strip to a building element below the flashing joint with the first adhesive strip and applying a second barrier sheet overlapping the first barrier sheet and adhere the first and second barrier sheets together using the second adhesive strip. The process can include applying flashing over the first barrier sheet and flashing joint and then overlaying the flashing with the second barrier sheet and sealing the second barrier sheet to both the first barrier sheet and the flashing.

11 Claims, 1 Drawing Sheet

METHOD FOR SEALING FLASHING JOINTS BELOW FLASHING

CROSS REFERENCE STATEMENT

This application claims the benefit of U.S. Provisional Application No. 61/351,982, filed Jun. 7, 2010 the entire content of which is incorporated herein by reference.

BACKGROUND OF THE INVENTION

1. Field of the Invention

The present invention relates to a process for sealing building joints commonly covered with flashing materials in building construction and the resulting building structure.

2. Description of Related Art

Water and air penetration into building structures is problematic. Water intrusion is a significant source of warranty repair costs to most production builders. Areas of water intrusion can also be areas of air intrusion, which diminishes the insulation value of a structure. One avenue for water an air intrusion is through flashing joints in open frame structures. A flashing joint is an interface between two structural elements that is protected from outside elements by flashing material. Building codes and practices require protecting flashing joints from air and water penetration from above the flashing material but can neglect air and water penetration from below the flashing.

One particularly troublesome flashing joint is that between a wall and a slab foundation with stucco cladding installation. Such a flashing joint uses a weep screed to cover the interface between a slab foundation and a sill plate of a wall above the slab foundation. Building codes require barrier material to shingle lap over the top of a weep screed to seal the top of the weep screed and to direct water from above the flashing joint away from the interface between the weep screed and wall. However, the bottom of a weep screed is typically unprotected. Strong winds can drive air and water up from the bottom of the weep screed, between the weep screed and slab foundation, into a wall cavity. Current building codes and building techniques lack specified protection from penetration into a wall cavity from the bottom interface of a weep screed and slap foundation.

Another troublesome flashing joint is that at roof-wall transitions when flashing remains uncovered on the roof deck, such as is found in clay tile roofing applications. As with the weep screed construction, barrier material is often applied over a portion of the flashing extending up the wall portion of the transition to protect from wind and water penetration from above. However, driving wind and rain can still penetrate between the roof and flashing and up between the flashing and wall into the wall cavity.

It is desirable to develop an easy and simple method to seal flashing joints in building structures from penetration of wind and water from beneath a flashing material into wall cavities.

U.S. Pat. No. 5,091,235 discloses a sill wrap assembly that provides some protection for foundation flashing joints. The sill wrap assembly includes a batt of infiltration barrier material that requires placement in the structural foundation during construction. The batt of infiltration barrier material is adhered to a sheet (a "sealing flap") extending out from the foundation that can be sealed over the interface of the sill plate and slab foundation after the rest of the structure is assembled. The sealing flap has a strip of adhesive that can attach the sealing flap to the studs or outer sheathing of a structure. The sill wrap assembly must be installed during construction of the foundation of the structure leaving the sealing flap at risk of being damaged during construction of the remainder of the structure before being sealed over the sill plate-foundation interface. Additionally, the sill wrap has an adhesive strip that faces the studs of an open frame structure, which means adhesive will be exposed between studs allowing it to interfere with installing insulating to the stud spacing. Furthermore, the sill wrap design does not protect the wall cavity from wind and water that is driven up higher than the top of the sealing flap. The sill wrap is also not applicable to flashing joints other than those proximate to a foundation, and so is not applicable to roof-wall transitions.

It is desirable to develop an easy and simple method for protecting flashing joints in building structures from penetration of wind and water from beneath a flashing material into wall cavities. Moreover, it is desirable to identify a method for sealing flashing joints in a manner that can be introduced to a structure after constructing a structural frame and without exposing inter-stud spaces to adhesive strips. It is more desirable for such a method to be useful in applications using weep screed to provide better sealing of the corresponding flashing joint behind the weep screed than is achievable by current practices. It is further desirable for the method to be applicable to sealing many kinds of flashing joints as opposed to only those proximate to a structure's foundation. It is yet further desirable to provide a method for sealing flashing joints that will integrate with house wraps by providing a sealed joint between housewrap and the flashed joint seal thereby precluding water and wind from reaching a wall cavity from beneath flashing materials.

BRIEF SUMMARY OF THE INVENTION

The present invention provides an easy and simple method for protecting flashing joints in building structures from penetration of wind and water from beneath a flashing material into wall cavities. Moreover, it provides a method for sealing flashed joint in a manner that can be introduced to a structure after constructing a structural frame and without exposing inter-stud spaces to adhesive strips. It is useful in applications using weep screed to provide better sealing of the corresponding flashing joint behind the weep screed than is achievable by current practices. It is applicable to sealing many kinds of flashed joints as opposed to only those proximate to a structure's foundation. Moreover, it provides a method for sealing flashing joints that will integrate with house wraps by providing a sealed joint between housewrap and the flashed joint seal thereby precluding water and wind from reaching a wall cavity from beneath flashing materials In a first aspect, the present invention is a process for sealing a flashing joint comprising the steps: (a) providing an open frame structure comprising studs extending generally vertically from a first base element that resides proximate to a second base element where the two base elements define a flashing joint with the first base element above the flashing joint and the second base element below the flashing joint; (b) providing a first barrier sheet having a length, opposing first and second primary surfaces, opposing first and second edges along the barrier sheet length separated by a barrier sheet width, a first adhesive strip running along the length on the first primary surface proximate to the first edge and a second adhesive strip running along the length on the second primary surface proximate to the second edge; (c) applying the first barrier sheet to the open frame structure such that the first adhesive strip of the first barrier sheet is between the first barrier sheet and a building element below or extending from below the flashing joint and the second edge above the flashing joint so the first barrier sheet extends partially over the studs; (d) adhering the first adhesive strip to a building element below the flashing joint thereby sealing the first edge of the first barrier sheet to the building element that is below or extending from below the flashing joint; (e) providing and applying a second barrier sheet having opposing primary surfaces, a length and opposing first and second edges running its length over the studs of the open frame construction such that a portion of the second barrier sheet and its first edge at least partially overlaps the first barrier sheet with the second adhesive strip of the first barrier sheet between the first and second barrier sheets; and (f) adhering the first and second barrier sheets together with the second adhesive strip.

In a preferred embodiment, the process of the first aspect further comprises a step before or after step (e) that comprises attaching a flashing to the open frame structure over the first barrier sheet and flashing joint and wherein step (e) comprises applying the second barrier sheet so that it at least partially overlaps the flashing and includes sealing the first edge of the second barrier sheet to the flashing with adhesive.

In a second aspect, the present invention is a building structure comprising: (a) an open frame structure comprising studs extending generally vertically from a first base element that resides proximate to a second base element where the two base elements define a flashing joint with the first base element above the flashing joint and the second base element below the flashing joint; (b) a first barrier sheet having a length, opposing first and second primary surfaces, opposing first and second edges along the barrier sheet length separated by a barrier sheet width, a first adhesive strip running along the length on the first primary surface proximate to the first edge and a second adhesive strip running along the length on the second primary surface proximate to the second edge, the first barrier sheet residing on the open frame structure such that the first adhesive strip is between and adhering together the first barrier sheet and a building element below or extending from below the flashing joint and the second edge is above the flashing joint so the first barrier sheet extends partially over the studs; and (c) a second barrier sheet having opposing primary surfaces, a length and opposing first and second edges running its length over the studs of the open frame construction such that a portion of the second barrier sheet and its first edge at least partially overlaps the first barrier sheet with the second adhesive strip of the first barrier sheet between and adhering together the first and second barrier sheets.

A preferred embodiment of the second aspect is further characterized by a flashing attached to the open frame structure over the first barrier sheet and flashing joint and the second barrier sheet and its first edge partially overlapping the flashing with first edge of the second barrier sheet sealed to the flashing with an adhesive.

The process of the present invention has utility in open frame building and construction to seal flashing joints from penetration of wind and water from beneath flashing material. The process of the first aspect is useful for preparing the building structure of the second aspect.

DETAILED DESCRIPTION OF THE INVENTION

Figure 1:
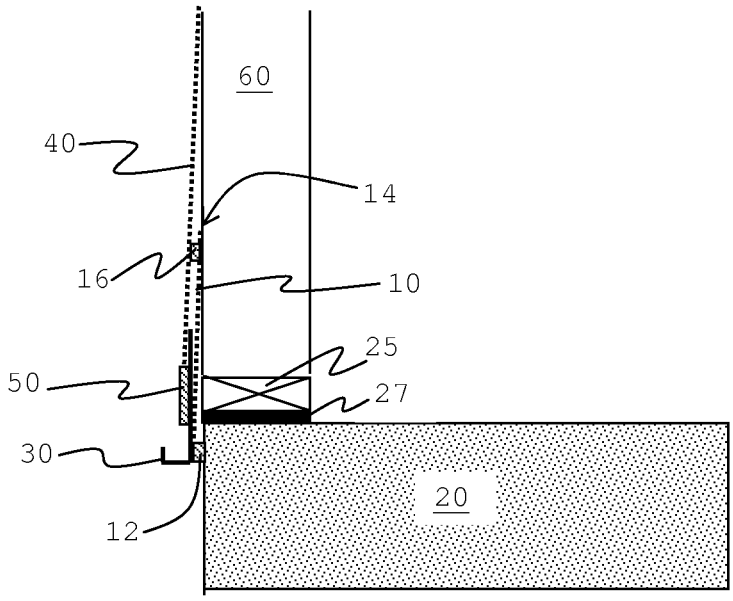
FIG. 1 is a profile schematic of a sealed foundation flashing joint resulting from Example 1.

Test methods refer to the most recent test method as of the priority date of this document unless the test method number includes a different date. References to test methods contain both a reference to the testing society and the test method number. The following test method abbreviations apply herein: ASTM refers to American Society for Testing and Materials; EN refers to European Norm; DIN refers to Deutsches Institute für Normung; and ISO refers to International Organization for Standards.

"Multiple" means two or more. "And/or" means "and, or as an alternative". All ranges include endpoints unless otherwise indicated.

"Open frame structure" refers to a building structure comprising building elements including base elements and studs with spacings between studs. "Open frame construction" refers to the building of an open frame structure.

"Building element" refers to any component in an open frame structure.

"Base element" refers to a building component defining a flashing joint.

"Flashing joint" refers to the seam between two building elements that are typically proximate to perpendicular structural features (for example, a floor and a wall or a roof and a wall) of an open frame structure. For example, where the sill plate of a wall meets a foundation slab in slab construction constitutes a flashing joint. In such an example the sill plate of the wall is one base element and the foundation slab is another base element. Also, roof-wall transitions in multi-story structures have flashing joints. Flashing joints are typically protected from outside elements by overlaying with flashing.

"Flashing" refers to pieces of sheet, typically sheet metal, attached to a structure flashing joints to protect the flashing joints from water leakage. Weep screeds are one form of flashing used in concrete slab construction.

The process of the present invention applies to an open frame structure. The open frame structure comprises studs extending generally vertically from a first base element that resides proximate to a second base element so as to define a flashing joint between the first and second base elements. The first base element is above the flashing joint and second base element is below the flashing joint.

The present invention is not limited as to the composition of the studs and base elements. Studs and base elements can be the same composition or can be of different compositions with respect to one another. Often, the studs and first base element are selected from wood or metal compositions. The second base element can also be of wood composition, including oriented stand board, composite wood material, or dimensional lumber. Alternatively, the second base element can be brick, cement block or cement slab such as in the foundation of a cement slab structure.

One common open frame structure comprises studs defining a wall extending from a wood or metal base element (sill plate) adjacent to a slab foundation, typically a cement slab foundation. The joint between the slab foundation and the sill plate defines a flashing joint. Typically, there is a water barrier or gasket material in the flashing joint between the slab foundation and the sill plate. In such an open frame structure the sill plate is the first base element that is above the flashing joint and the slab foundation is the second base element that is below the flashing joint.

Another flashing joint that can be present in multiple-story open frame structures is at roof-wall transitions, that is where a roof meets a wall extending above the roof. For example walls of dormers extend essentially vertically from the roof of a structure and have a flashing joint at the interface of the dormer wall base element and the roofing. In such a structure the base element of the second story wall is a first base element that is above the flashing joint and can be in the form of a starter board or sill plate. The roofing deck is typically the second base element that is below the flashing joint. Similar flashing joints can occur between a roof and any wall of an open frame structure extending above the roof (for example, a third story wall, fourth story wall or attic wall).

The process of the present invention utilizes barrier sheets. Barrier sheets are typically housewrap materials. Housewraps are common in the building industry as thin, lightweight sheathing for building structures that provide a weather barrier (particularly for water and air) between the inside and outside of walls. Desirably, the barrier sheets are moisture breathable to prevent build-up of moisture proximate to insulation that typically resides in the building walls. Suitable barrier sheets include nonwoven sheets of polyolefins such as polyethylene and polypropylene. Desirable barrier sheets are those commonly known as housewraps. Commercially available materials suitable as a barrier sheets include WEATHERMATE™ and WEATHERMATE™ Plus brand housewraps (WEATHERMATE is a trademark of The Dow Chemical Company), TYVEK™ brand house wrap (TYVEK is a trademark of DuPont) and TYPAR™ brand house wrap (TYPAR is a trademark of Fiberweb, Inc.).

Provide a first barrier sheet that has a length, opposing first and second primary surfaces and opposing first and second edges that run along the length. Primary surfaces are the opposing surfaces having largest surface area. Length is the largest dimension of a barrier sheet. The distance between opposing first and second edges defines the barrier sheet width. Typically, the first barrier sheet has a width in a range of 30 to 40 centimeters.

The first barrier sheet has a first strip of adhesive that runs the length of the sheet on the first primary surface proximate to the first edge and a second adhesive strip that runs the length of the barrier sheet on the second primary surface proximate to the second edge. It is desirable for the first and second adhesive strips to run continuously the full length of the barrier sheet in order to facilitate an optimal seal. The two adhesive strips can be identical except for their location, or they can differ in composition, dimension, or both composition and dimension from one another. The adhesive strips span less than the bather sheet width and typically span less than one tenth of the barrier sheet width. Generally, each adhesive strip extends one centimeter (cm) or more, preferably two cm or more and at the same time five cm or less, preferably four cm or less and generally three cm or less across the barrier sheet width on average along the length of the first barrier sheet.

Each adhesive strip comprises an adhesive suitable for affixing the barrier sheet to a construction element. Suitable adhesives include, but are not necessarily limited to, any known or yet to be developed peal-and-stick adhesive including those based on the following chemistries: butyl, butyl blends, asphalt and acrylic. In one embodiment one or both of the adhesive strips comprise a butyl adhesive material, preferably a butyl adhesive material covered with a protective release paper. To adhere the adhesive strip having a protective release paper to something remove the protective release paper and then press the barrier sheet against a surface with the adhesive between the barrier sheet and surface.

Apply the first barrier sheet over a flashing joint of the open frame structure with the first adhesive strip between the first barrier sheet and a building element below or extending from below the flashing joint. Adhere the first adhesive strip to the building element below or extending from below the flashing joint thereby sealing the first barrier sheet to the building element so as to cover the flashing joint. The building element may or may not be a base element. For example, the first barrier sheet can adhere to the slab foundation in a foundation flashing joint in which case the building element is a base element. However, in a wall-roof transition the building element to which the first barrier sheet attaches may be felt paper or some other barrier that extends from the roof deck up the wall a ways thereby covering the base first base element. The first barrier sheet can adhere to the felt paper either above or below the flashing joint due to the fact that the felt paper extends from below the flashing joint. The seal between the first barrier sheet and the building element below or extending from below the flashing joint should preclude penetration of water or air between the first barrier sheet and the base element below the flashing joint. The second edge of the barrier sheet should be above the flashing joint so the first barrier sheet extends partially over studs of the open frame structure. The second adhesive strip remains showing with the first barrier sheet between the second adhesive strip and the studs.

Provide a second barrier sheet having a length and opposing primary surfaces, a length and opposing first and second edges running its length. Apply the second barrier sheet over the studs of the open frame construction such that a portion of the second barrier sheet and its first edge at least partially overlaps the first barrier sheet with the second adhesive strip of the first barrier sheet between the first and second barrier sheets. Adhere the first and second barrier sheets together with the second adhesive strip of the first barrier sheet. As a result, the first and second barrier sheets desirably have a water and air impermeable seal between them.

One preferred embodiment of the present invention further includes attaching flashing to the open frame construction over the first barrier sheet and sealing over the top of the flashing with the second barrier sheet. Apply the flashing so that it partially covers the first barrier sheet, which extends up behind the flashing with the second adhesive strip remaining exposed above the flashing. In this preferred embodiment, apply the second barrier sheet so that its first edge overlaps the flashing. Seal the first edge of the second barrier sheet to the flashing with adhesive, such as adhesive tape, so as to form a water tight and air tight seal between the flashing and second barrier sheet. The second barrier sheet extends above the flashing and beyond the first barrier sheet over studs of the open frame construction. Adhere the first and second barrier sheets together using the second adhesive strip of the first barrier sheet to form a seal between the two barrier sheets. The resulting construction precludes water and moisture from penetrating up from beneath the flashing and into the wall cavity behind the flashing.

Suitable flashing includes weep screed, metal sheet in any configuration, plastic sheet or strip in any configuration, rubber sheet or strip in any configuration, or any other barrier material used now or in the future for specific protection of flashing joints.

The following are two examples of the present invention. In the following examples, the bather sheets are WEATHERMATE™ Plus brand housewrap, first and second adhesive strips are butyl-based adhesives that are 0.5 millimeters thick and 2.54 centimeters wide, and the second barrier sheet was adhered to the flashing using construction tape. The first barrier sheet has a width of 30.5 centimeters. The examples can be reproduced using other housewrap materials, dimensions, adhesive strip materials and adhesives for adhering the second barrier sheet to the flashing.

EXAMPLE 1

Foundation Flashing

FIG. 1 illustrates one particular useful application of the process of the present invention as protection of a foundation flashing joint in slab construction, particularly when a weep screed is used as flashing around such a flashing joint. In such an application apply first barrier sheet 10 as described above, over the foundational flashing joint defined at the juncture of slab foundation 20 and sill plate 25. Generally, the flashing joint includes a sill seal gasket 27 between slab foundation 20 and sill plate 25. Attach first adhesive strip 12 of first barrier sheet 10 to slab foundation 20. Install weep screed 30 against first barrier sheet 10. Apply second barrier sheet 40 as described above so that it overlaps weep screed 30 and extends above second edge 14 of the first barrier sheet 10 and over studs 60. Seal the first edge (not shown) of second barrier sheet 40 to weep screed 30 using adhesive 50, such as adhesive tape, so that weep screed 30 extends between first and second barrier sheets 10 and 40. Then seal first and second barrier sheets 10 and 40 together using second adhesive strip 16 of first barrier sheet 10. Note that adhesive strips 14 and 16 as well as adhesive 50 are shown unnecessarily thick to make them visible in the figure. The flashing joint is protected from wind and water penetration from underneath weep screed 30. The resulting building structure is a building structure of the present invention.

EXAMPLE 2

Roof-Wall Transition

Figure 2:
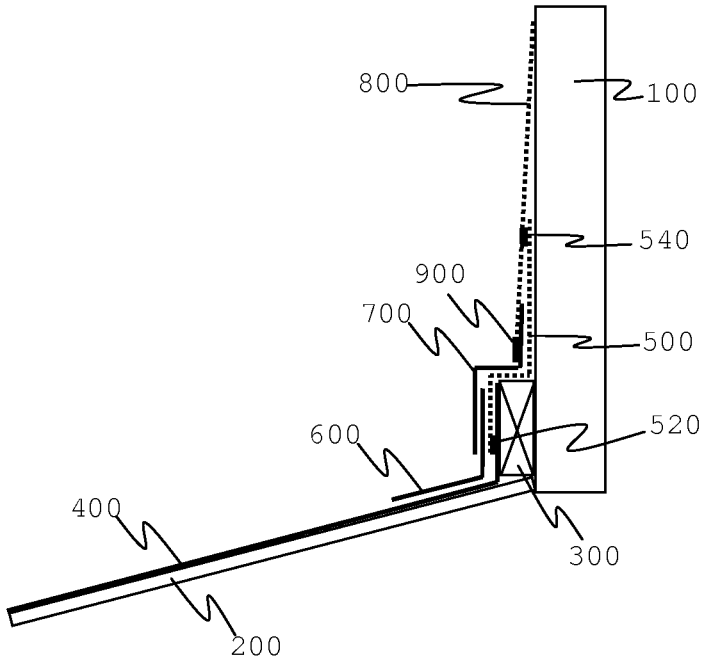
FIG. 2 is a profile schematic of a sealed roof-wall transition flashing joint resulting from Example 2.

FIG. 2 illustrates another application of the present invention, this one to a roof-wall transition. Studs 100 and roof deck 200 form a flashing joint along their juncture. Generally a starter board, such as 300, runs along the flashing joint and can serve as the first base element. Roofing felt 400 runs over roof deck 20 and up starter board 300. Apply first barrier sheet 500 so that it overlays roofing felt 400 and extends up partially over studs 100. First adhesive strip 520 resides between first barrier sheet 500 and roofing felt 400. Apply angle flashing 600 over roofing felt 400 so that it overlays part of first barrier sheet 500. Apply a second z-flashing 700 so that it conforms to starter board 300 and overlaps flashing 600 and extends up partially along studs 100. First barrier sheet 500 should extend up along studs 100 higher than z-flashing 700 so that second adhesive strip 540 of first barrier sheet 500 remains exposed. Apply second barrier sheet 800 partially over z-flashing 700 so that it extends over second adhesive strip 540 and up over studs 100 beyond first barrier sheet 500. Adhere second barrier sheet 800 to z-flashing 700 with adhesive 900 (adhesive 900 can be adhesive tape) and to first barrier sheet 500 using second adhesive strip 540. The wall cavity is protected from water and wind penetration beneath flashing 600 and/or z-flashing 700. The resulting building structure is a building structure of the present invention.

What is claimed is:

1. A process for sealing a flashing joint comprising the steps:

(a) providing an open frame structure comprising studs extending generally vertically from a first base element that resides proximate to a second base element where the two base elements define a flashing joint with the first base element above the flashing joint and the second base element below the flashing joint;

(b) providing a first barrier sheet having a length, opposing first and second primary surfaces, opposing first and second edges along the barrier sheet length separated by a barrier sheet width, a first adhesive strip running along the length on the first primary surface proximate to the first edge and a second adhesive strip running along the length on the second primary surface proximate to the second edge;

(c) applying the first barrier sheet to the open frame structure such that the first adhesive strip of the first barrier sheet is between the first barrier sheet and a building element below or extending from below the flashing joint and the second edge above the flashing joint so the first barrier sheet extends partially over the studs;

(d) adhering the first adhesive strip to a building element below the flashing joint thereby sealing the first edge of the first barrier sheet to the building element that is below or extending from below the flashing joint;

(e) providing and applying a second barrier sheet having opposing primary surfaces, a length and opposing first and second edges running its length over the studs of the open frame construction such that a portion of the second barrier sheet and its first edge at least partially overlaps the first barrier sheet with the second adhesive strip of the first barrier sheet between the first and second barrier sheets; and (f) adhering the first and second barrier sheets together with the second adhesive strip.

2. The process of claim 1, further comprising a step before or after step (e) that comprises attaching a flashing to the open frame structure over the first barrier sheet and flashing joint and wherein step (e) comprises applying the second barrier sheet so that it at least partially overlaps the flashing and includes sealing the first edge of the second barrier sheet to the flashing with adhesive.

3. The process of claim 2, wherein application of the flashing occurs prior to step (e).

4. The process of claim 2, wherein adhesive tape is the adhesive for sealing the first edge of the second barrier sheet to the flashing.

5. The process of claim 2, wherein the flashing is a weep screed, the flashing joint is the space between a sill-plate and a concrete slab foundation and the base element of step (d) is the concrete slab foundation.

6. The process of claim 1, wherein the adhesive strip is a butyl adhesive material.

7. The process of claim 6, further characterized by the butyl adhesive material remaining covered by a protective release paper that is removed just prior to when the adhesive strip is adhered to something else.

8. The process of claim 1, wherein the first barrier sheet width is in a range of 30 to 40 centimeters.

9. The process of claim 1, wherein the adhesive strips cover less than one tenth of the barrier sheet width.

10. A building structure comprising:

(a) an open frame structure comprising studs extending generally vertically from a first base element that resides proximate to a second base element where the two base elements define a flashing joint with the first base element above the flashing joint and the second base element below the flashing joint;

(b) a first barrier sheet having a length, opposing first and second primary surfaces, opposing first and second edges along the barrier sheet length separated by a barrier sheet width, a first adhesive strip running along the length on the first primary surface proximate to the first edge and a second adhesive strip running along the length on the second primary surface proximate to the second edge, the first barrier sheet residing on the open frame structure such that the first adhesive strip is between and adhering together the first barrier sheet and a building element below or extending from below the flashing joint and the second edge is above the flashing joint so the first barrier sheet extends partially over the studs; and (c) a second barrier sheet having opposing primary surfaces, a length and opposing first and second edges running its length over the studs of the open frame construction such that a portion of the second barrier sheet and its first edge at least partially overlaps the first barrier sheet with the second adhesive strip of the first barrier sheet between and adhering together the first and second barrier sheets.

11. The building structure of claim 10, further characterized by a flashing attached to the open frame structure over the first barrier sheet and flashing joint and the second barrier sheet and its first edge partially overlapping the flashing with first edge of the second barrier sheet sealed to the flashing with an adhesive.

* * * * *